US007821369B2

(12) United States Patent
Sano

(10) Patent No.: US 7,821,369 B2
(45) Date of Patent: Oct. 26, 2010

(54) MAGNETIC ELEMENT

(75) Inventor: Kan Sano, Tokyo (JP)

(73) Assignee: Sumida Corporation (JP)

( * ) Notice: Subject to any disclaimer, the term of this patent is extended or adjusted under 35 U.S.C. 154(b) by 0 days.

(21) Appl. No.: 12/395,281

(22) Filed: Feb. 27, 2009

(65) Prior Publication Data

US 2009/0160591 A1 Jun. 25, 2009

Related U.S. Application Data

(63) Continuation of application No. 11/828,143, filed on Jul. 25, 2007, now Pat. No. 7,612,640.

(30) Foreign Application Priority Data

Jul. 26, 2006 (JP) ..... 2006-202926

(51) Int. Cl.
*H01F 38/12* (2006.01)

(52) U.S. Cl. ..... 336/84 M

(58) Field of Classification Search ..... 336/65, 336/83, 84 R, 84 M, 212, 200, 232–234
See application file for complete search history.

(56) References Cited

U.S. PATENT DOCUMENTS 3,593,217 A * 7/1971 Weber ..... 333/175
4,314,221 A * 2/1982 Satou et al. ..... 336/83
4,400,674 A * 8/1983 Suda et al. ..... 336/65
4,769,900 A * 9/1988 Morinaga et al. ..... 29/606
5,010,313 A * 4/1991 Kaneko et al. ..... 335/296
5,680,087 A * 10/1997 Sakata et al. ..... 336/83
7,209,022 B2 * 4/2007 Kuroiwa et al. ..... 336/83

FOREIGN PATENT DOCUMENTS

JP 2004-281778 10/2004

* cited by examiner

*Primary Examiner*—Tuyen Nguyen
(74) *Attorney, Agent, or Firm*—Stephen Chin; von Simson & Chin, LLP

(57) ABSTRACT

To provide a magnetic element the ends of the coil of which can be drawn out from the core easily, is compact, and further, is one in which magnetic saturation does not arise easily. A magnetic element has a core unit provided with a wound coil, a center core 105 inserted into the interior of the inner periphery of the coil, planar cores disposed at both ends of the center core, and a side core disposed between the planar cores and on the outside periphery of the coil. The side core is disposed so as to form an open portion between the two planar cores around the coil, with a recessed portion formed in a surface of the side core facing the coil in which the coil is partially contained.

13 Claims, 8 Drawing Sheets

MAGNETIC ELEMENT

CROSS-REFERENCE TO RELATED APPLICATIONS

This application is a continuation of Ser. No. 11/828,143 filed on Jul. 25, 2007 now U.S. Pat. No. 7,612,640, which claims priority rights from Japanese Patent Application No. 2006-202926, filed on Jul. 26, 2006, the entire disclosure of which is hereby incorporated by reference herein.

BACKGROUND OF THE INVENTION

1. Field of the Invention

The present invention relates to a magnetic element.

2. Background of the Invention

Conventionally, many magnetic elements having a structure in which a rectangular or cylindrical ring core is disposed around the periphery of a circular drum core, in which a coil is wound around a winding axis, are known (see, for example, Japanese patent laid-open publication 2006-73847). However, in the magnetic elements having the structure described above, there is a problem that the ends of the coil being wound around the winding axis of the drum core are difficult to be pulled out toward the terminals when connecting the terminals with the coil because the ring core surrounds the periphery of the drum core.

As a solution to this problem, a configuration is disclosed in Japanese patent laid-open publication 2004-111754 in which a planar core is disposed in four directions consisting of both sides of the axial direction of the winding axis as well as both sides of the perpendicular direction to the winding axis so as to sandwich the coil wound around the columnar core, the directions perpendicular to the four directions in which the planar core described above is provided are opened, and the ends of the coil are drawn out from these opened locations.

FIGS. 11A-11C show an exploded perspective view of a magnetic element 500 of the Japanese patent laid-open publication 2004-111754. The magnetic element 500 comprises an upper first core 501, a lower second core 502, and two coils 503, 504.

The first core 501, shown in FIG. 11(A), comprises a flat plane portion 501*a*; three planar side legs, 501*b*, 501*b*, and 501*b*, which project from a pair of opposed short ends as well as from the middle of the flat plane portion 501*a*; and columnar central legs 501*d*, 501*d* projecting from the centers of each of the recessed portions 501*c*, 501*c*, which are surrounded by the adjacent side legs 501*b*, 501*b*. In addition, four openings, 501*e*, 501*e*, 501*e*, 501*e*, are provided in a pair of opposed long ends along which no side leg 501*b* is provided.

Each of the two coils 503, 504 shown in FIG. 11(B) is an edgewise coil that is formed by winding rectangular wires coated with insulation. The insulation is peeled back from the beginnings and the ends of the windings of the coils 503, 504, and the ends solder plated and furthermore deformed into L-shaped forms so as to form ends 503*a*, 504*a* that are the terminals to be electrically connected.

The second coil 502 shown in FIG. 11C has a rectangular, flat plane shape having short and long sides of lengths substantially identical to those of the short and long sides of the first core 501.

The coils 503, 504 fit into the recessed portions 501*c*, 501*c* of the first core 501, in a state in which the central legs 501*d*, 501*d* are inserted into center openings 503*b*, 504*b*. Then, in a state in which the coils 503, 504 are inserted into the recessed portions 501*c*, 501*c* of the first core 501, the second core 502 and the first core 501 are brought together, and the recessed portions 501*c*, 501*c* are sealed by the second core 502.

Therefore, on both sides in the winding axis direction of the coils 503, 504, the flat plane portion 501*a* of the first core 501 and the second core 502 are disposed. In addition, in directions perpendicular to the winding axis of coil 503, side legs 501*b*, 501*b* are disposed so as to sandwich the coil 503, and moreover, in directions perpendicular to the winding axis of coil 504, side legs 501*b*, 501*b* are disposed so as to sandwich the coil 504. In other words, in the four directions of the coil 503, a closed magnetic path is formed by the flat plane portion 501*a* of the first core 501, the second core 502, the side legs 501*b* and 501*b*. In addition, in the four directions of the coil 504, a closed magnetic path is formed by the flat plane portion 501*a* of the first core 501, the second core 502, the side legs 501*b* and 501*b*.

By contrast, in the recessed portion 501*c* in which the coil 503 is holded, the openings 501*e* and 501*e* are formed. In addition, in the recessed portion 501*c* in which the coil 504 is holded, the openings 501*e* and 501*e* are formed.

As a result, from these openings 501*e*, 501*e*, 501*e* and 501*e*, the ends of the coils 503 and 504 can be drawn out easily.

However, with the magnetic element having the structure disclosed in Japanese Patent Laid-open publication 2004-111754, because the side legs 501*b*, 501*b*, 501*b* are planar, their cross-sectional area is small and magnetic saturation is easily caused.

If the thicknesses of the side legs 501*b*, 501*b*, 501*b* are increased and their cross-sectional area is increased, then in order not to increase the mounting surface area of the magnetic element 500, it is necessary to increase the thicknesses of the side legs 501*b*, 501*b*, 501*b* toward the side of the coils 503, 504. When that is done, distance between the side legs 501*b*, 501*b*, 501*b* and the central legs 501*d*, 501*d* becomes narrower. As a result, the number of windings of the coils 503 and 504 is limited, and it is impossible to increase inductance value sufficiently. In addition, as such distance becomes narrower, when an attempt is made to increase the number of windings of the coils 503, 504, it is necessary to reduce the thicknesses of the winding wires, then it becomes impossible to achieve direct current resistance reduction. Conversely, if increasing the thicknesses of the side legs 501*b*, 501*b*, 501*b* toward the opposite side of the coils 503, 504, the size of the magnetic element 500 itself increases.

SUMMARY OF THE INVENTION

In order to solve problems described above, the present invention has as its object to provide a magnetic element the ends of the coil of which can be drawn out from the core easily, is compact, and further, is one in which magnetic saturation does not arise easily. In addition, the present invention has as its object to provide a magnetic element that relaxes restrictions on the number of windings in the coil and thereby enables a large inductance value to be obtained, or, alternatively, even if the number of windings is increased, relaxes restrictions on the thickness of the winding wire used so as to enable direct current resistance reduction.

To achieve the above-described object, the present invention provides a magnetic element comprising a wound coil, a core body having a center core inserted into the inner periphery of the coil, planar cores disposed at both ends of the center core, and a side core disposed between the planar cores and on an outside periphery of the coil. The side core is disposed so as to form an open area between the two planar cores around the coil, with a recessed portion formed in a surface of the side core facing the coil in which the coil is partially contained.

Giving the magnetic element such a configuration enables the ends of the coil to be easily drawn out of the core body from the open area. In addition, forming a recessed portion in the surface of the side core that faces the coil in which the coil is partially contained enables the magnetic element to remain compact, and moreover, enables the cross-sectional area of the side core to be increased; as a result, this makes it possible to prevent easy occurrence of magnetic saturation. In addition, because it is possible to secure a distance between the center core and the side core, restrictions on the number of windings is relaxed, thereby enabling a large inductance value to be obtained. Or, alternatively, even if the number of windings is increased, restrictions on the thickness of the winding wire used are relaxed, thereby enabling direct current resistance reduction to be achieved.

In another aspect of the present invention, the side core and the center core form a single integrated unit with at least one of the two planar cores.

Configuring the magnetic element as described above, in addition to reducing the number of components, enables to reduce leakage magnetic flux because the side core and the center core form a single integrated unit with at least one of the two planar cores, and therefore these joint sections form a single integrated unit.

In another aspect of the present invention, a relation between a cross-sectional area S1 of the side core and a cross-sectional area S2 of the center core is such that $S2 \leqq S1 \leqq 5 \times S2$.

Configuring the magnetic element as described above enables to make it more difficult for magnetic saturation to occur.

In another aspect of the present invention, a relation between the cross-sectional area S2 of the center core and a cross-sectional area S3 of the planar core is such that $S2 \leqq S3 \leqq 5 \times S2$.

Configuring the magnetic element as described above enables to make it more difficult for magnetic saturation to occur.

In another aspect of the present invention, the side core is provided at a center of the planar core in a long direction of the planar core, and the center core is provided at two locations between the side core and both ends of the planar core in the long direction thereof.

Configuring the magnetic element as described above enables one magnetic element to generate two magnetic fields.

In another aspect of the present invention, a relation between a cross-sectional area S4 of the side core and a cross-sectional area S5 of the center core is such that $S5+S5 \leqq S4 \leqq 5 \times (S5+S5)$.

Configuring the magnetic element as described above enables to make it more difficult for magnetic saturation to occur.

In another aspect of the present invention, a relation between the cross-sectional area S5 of the center core and a cross-sectional area S6 of the planar core is such that $S5 \leqq S6 \leqq 5 \times S5$.

Configuring the magnetic element as described above enables to make it more difficult for magnetic saturation to occur.

In another aspect of the present invention, the side core is mounted at both ends of the planar core in the long direction thereof, and the center core is provided at two locations with a predetermined distance apart between the two side cores.

Configuring the magnetic element as described above enables one magnetic element to generate two magnetic fields.

In another aspect of the present invention, a relation between a cross-sectional area S7 of the side core and a cross-sectional area S8 of the center core is such that $S8 \leqq S7 \leqq 5 \times S8$.

Configuring the magnetic element as described above enables to make it more difficult for magnetic saturation to occur.

In another aspect of the present invention, a relation between the cross-sectional area S8 of the center core and across-sectional area S9 of the planar core is such that $S8 \leqq S9 \leqq 5 \times S8$.

Configuring the magnetic element as described above enables to make it more difficult for magnetic saturation to occur.

In another aspect of the present invention, a side core is mounted at both ends of the planar core in a short direction thereof, and the center core is provided at two locations with a predetermined distance apart between the two side cores in parallel direction.

Configuring the magnetic element as described above enables one magnetic element to generate two magnetic fields.

In another aspect of the present invention, a relation between a cross-sectional area S10 of the side core and a cross-sectional area S11 of the center core is such that $S11+S11 \leqq S10 \leqq 5 \times (S11+S11)$.

Configuring the magnetic element as described above enables to make it more difficult for magnetic saturation to occur.

In another aspect of the present invention, a relation between a cross-sectional area S11 of the center core and a cross-sectional area S12 of the planar core is such that $S11 \leqq S12 \leqq 5 \times S11$.

Configuring the magnetic element as described above enables to make it more difficult for magnetic saturation to occur.

In another aspect of the present invention, an adhesive containing magnetic material is applied around the coil.

By configuring the magnetic element as described above, the periphery of the coil is covered with an adhesive coating containing magnetic material, thus enabling leakage magnetic flux to be reduced.

In another aspect of the present invention, at least one of the center core, the planar core and the side core is formed from compressed metal powder. Configuring the magnetic element as described above enables the saturation magnetic flux density to be increased, thus further enabling the magnetic element to be made more compact.

With the present invention, a magnetic element the ends of the coil of which can be drawn out from the core easily, is compact, and further, is one in which magnetic saturation does not arise easily, can be obtained. In addition, with the present invention, a magnetic element can be obtained that relaxes restrictions on the number of windings in the coil and thereby enables a large inductance value to be obtained, or, alternatively, relaxes restrictions on the thickness of the winding wire used so as to achieve direct current resistance reduction even if the number of windings is increased. Other features, objects and advantages of the present invention will be apparent from the following description when taken in conjunction with the accompanying drawings, in which like reference characters designate the same or similar parts throughout the figures thereof.

DETAILED DESCRIPTION OF THE PREFERRED EMBODIMENTS

Preferred embodiments of the present invention will now be described, with reference to the accompanying drawings. It should be noted, however, that the present invention is not limited to the following embodiments.

First Embodiment

First, a description is given of a first embodiment of a magnetic element according to the present invention.

Figure 1:
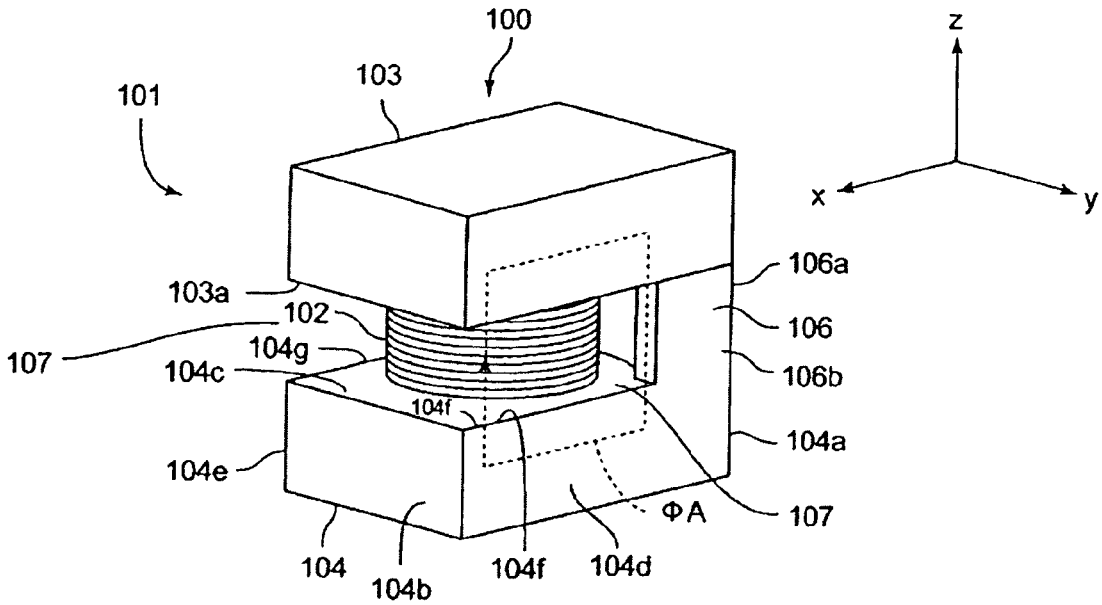
FIG. 1 is a perspective view of a magnetic element according to a first embodiment of the present invention.
Figure 2:
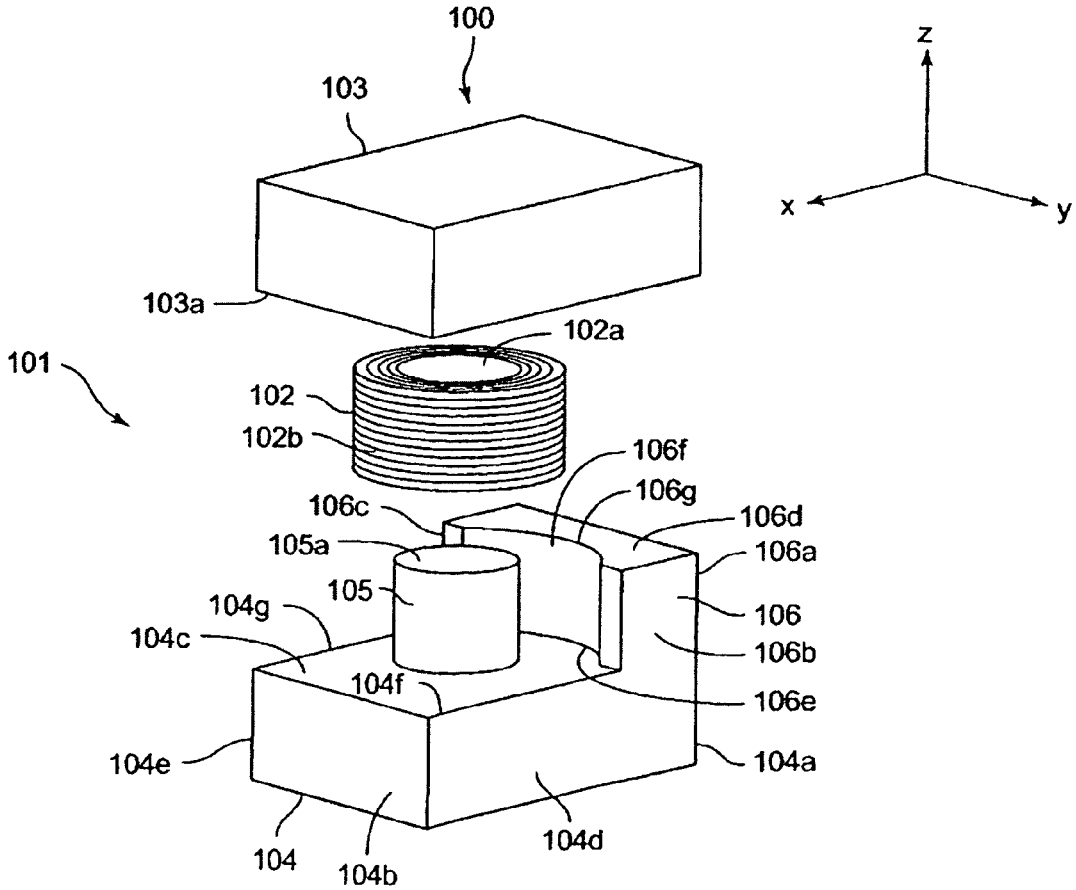
FIG. 2 is an exploded perspective view of the magnetic element shown in FIG. 1.

FIG. 1 is a perspective view of a magnetic element according to the first embodiment of the present invention. In addition, FIG. 2 is an exploded perspective view of the magnetic element shown in FIG. 1.

An inductance element 100 as a magnetic element has a core unit 101 and a coil 102. The core unit 101 has planar cores 103, 104, a center core 105, and a side core 106. The planar cores 103, 104 are wholly thin, flat, rectangular solids in the long direction of the center core 105, and both have substantially identical shapes.

In the following description, a direction from a short side surface 104*a* to a short side surface 104*b* of the planar core 104 is referred to as the front (front side), the reverse direction thereof is referred to as the rear (rear side), a right-hand direction, looking from the rear toward the front, is referred to as right (right side), and a left-hand direction looking from the rear toward the front is referred to as left (left side). In addition, a direction in which the planar core 103 is disposed with respect to the planar core 104 is referred to as up (upper side) and the reverse direction thereof is referred to as down (lower side). In other words, in the drawings, the x-axis direction is front, the Y-axis direction is left, and the Z-axis direction is up.

The center core 105 is a cylindrical column, with its long direction in the vertical direction.

The side core 106 is substantially saddle-shaped column in cross-section along a plane in the lateral and longitudinal directions of the planar core 104, in other words, along in the X-Y plane. That is, a rear side surface 106*a*, left and right lateral surfaces 106*b*, 106*c*, and a top end surface 106*d* of the side core 106 are all flat, with a recessed portion 106*g* curved in the shape of an inward- (rearward-) facing arc formed in a front side surface 106*f*. It should be noted that the side core 106 is columnar, and its shape in cross-section is the same from a portion 106*e* at which it joins the planar core 104 to the top end surface 106*d*.

The planar core 104, the center core 105 and the side core 106 are formed into a single integrated unit by sintering, or the like, a magnetic powder such as ferrite. The center core 105 and the side core 106 are mounted on an upper wide surface 104*c* of the planar core 104 with projecting upwardly. The center core 105 is mounted on substantially center of the upper wide surface 104*c* of the planar core 104.

The side core 106 is disposed backward of the center core 105. The rear side surface 106*a* is disposed so as to be flush with the short side surface 104*a* of the planar core 104. In addition, a width of the side core 106 in the lateral direction is the same as a width of the planar core 104 in the lateral direction, and side surfaces 106*b*, 106*c* of the side core 106 are disposed so as to be flush with the lateral long side surfaces 104*d*, 140*e* of the planar core 104.

The coil 102 is a wound wire coil formed by winding copper wire in a cylindrical shape, having a hollow portion 102*a* formed in the inner periphery thereof. The coil 102 is set on the planar core 104 by inserting the winding core 105 into the hollow portion 102*a*.

It should be noted that the center core 105 and the side core 106 are each disposed at positions that secure a distance, such that the side core 106 and the coil 102 do not interfere with each other when the center core 105 is inserted into the coil 102.

After the center core 105 is inserted into the coil 102, a wide surface 103*a* of the planar core 103 is placed against a top end surface 105*a* of the center core 105, and the top end surface 106*d* of the side core 106 and the joined surfaces are adhesively fixed in place with an adhesive agent, thus forming the planar cores 103, 104, the winding core 105, and the side core 106 into a single integrated unit so as to form the core unit 101.

Therefore, in the core unit 101, when an electric current is passed through the coil 102, a magnetic field (magnetic flux F A) that passes through the center core 105, the planar core 103, the side core 106, the planar core 104 and the center core 105 is produced. In other words, the center core 105, the planar core 103, the side core 106, the planar core 104, and the center core 105 form a closed magnetic path. It should be noted that the direction of the magnetic flux changes with the direction of the electric current passing through the coil 102.

In the core unit 101, an open portion 107 is formed between the planar core 103 and the planar core 104 in the direction of front of and lateral to the center core 105 because the side core 106 is mounted on the side of the short side surface 104*a* of the planar core 104 that is positioned at backward of the center core 105. As a result, the ends of the coil 102 can be easily drawn out of the core unit 101 from the open portion 107.

Figure 3:
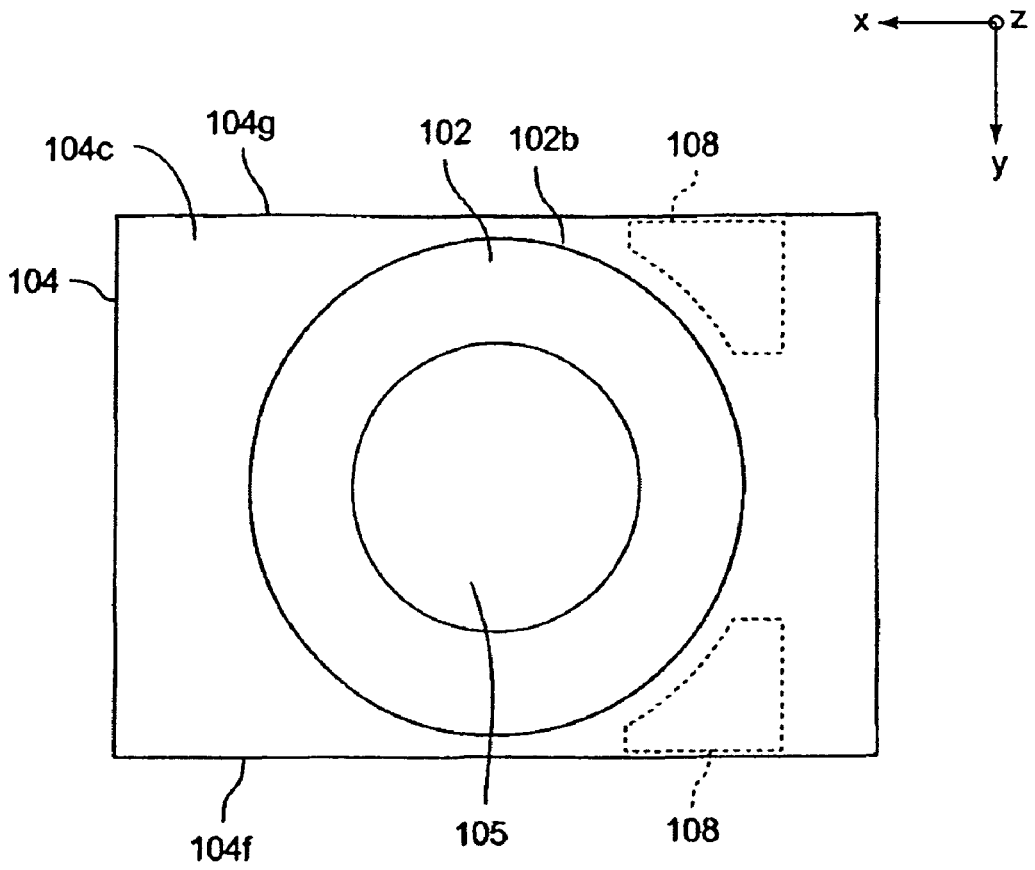
FIG. 3 is a view of a planar core as seen from above, showing a dead space between edges of the planar core and a coil, in the magnetic element shown in FIG. 1.

However, whereas lateral edge portions 104*f*, 104*g* of the wide surface 104*c* of the planar core 104 on which the coil 102 rests are straight lines, the outer peripheral surface of the coil 102 is a cylindrical surface. Therefore, substantially triangular spaces 108 whose hypotenuses are arc-shaped are formed as dead spaces between the lateral side surfaces on the rear side of the coil 102 and the edges 104*f*, 104*g*, as indicated by the dotted lines in FIG. 3. It should be noted that FIG. 3 shows the planar core 104 as seen from above, with the side core 106 omitted to facilitate the description.

The recessed portion 106*g* formed in the front side surface 106*f* of the side core 106 is a curved surface, concave in the shape of a concentric arc of greater curve than the outer peripheral surface 102*b* of the coil 102 so as to accommodate the shape of the outer peripheral surface 102*b* of the coil 102. In other words, the side core 106 is shaped so as to extend into the spaces 108 as the side core 106 extends toward the sides of the side surfaces 106*b*, 106*c* from a lateral center side, with a portion of the coil contained in the recessed portion 106*g*. As a result, the cross-sectional area of the side core 106, that is, the surface area of the top end surface 106*d*, can be increased without interfering with the coil 102.

Consequently, it results in making it difficult for magnetic saturation of the magnetic flux F A passing from the planar core 103 through the side core 106 to the planar core 104 to arise. For example, if the front side surface 106*f* of the side core 106 is made flat and the side core 106 is made into a rectangular solid without forming the recessed portion 106*g* in the front side surface 106*f*, and an attempt is made to increase the cross-sectional area of the side core 106, the thickness of the side core 106 in the longitudinal direction increases overall, and the space for arranging the coil 102 (the so-called winding frame) decreases.

By contrast, by forming in the front side surface 106*f* that faces the coil 102 the concave recessed portion 106*g* so as to accommodate the shape of the outer peripheral surface 102*b* of the coil 102, the cross-sectional area of the side core 106 can be increased without decreasing the winding frame. In other words, the cross-sectional area of the side core 106 can be increased without decreasing the size of the coil 102. In addition, because a distance between the center core 105 and the side core 106 can be secured, the number of windings of the coil 102 can be increased, thus enabling a large inductance value to be obtained. Or, alternatively, even if the number of windings is increased, the thickness of the winding wire of the coil 102 can be increased, thus aiding direct current resistance reduction.

Moreover, even if the cross-sectional area of the side core is increased, the mounting surface area of the inductance element 100 is not increased because the side core 106 extends into the spaces 108 that are dead spaces. In other words, in the inductance element 100, the surface areas of the wide surfaces 103*a*, 104*c* of the planar cores 103, 104 are the mounting surface areas. By extending the side core 106 into the spaces 108, the cross-sectional area of the side core 106 is increased, and therefore the surface areas of the wide surfaces 103*a*, 104*c* of the planar cores 103, 104 do not increase.

By making a cross-sectional area (top end surface 106*d*) S1 of the side core 106, with respect to a cross-sectional area S2 of the center core 105, that is, the surface area of the top end surface 105*a*, such that $S2 \leqq S1 \leqq 5 \times S2$, it is possible to effectively make it more difficult for magnetic saturation to occur in the side core 106.

In addition, by making a cross-sectional area S3 of the vertical cross-section of planar cores 103, 104, with respect to the cross-sectional area S2 of the winding core 105, such that $S2 \leqq S3 \leqq 5 \times S2$, it is possible to effectively make it more difficult for magnetic saturation to occur in the planar cores 103, 104.

Further, a height in a vertical direction of the center core 105 may be made somewhat shorter than a height in a vertical direction of the side core 106 (for example, 1 mm shorter), the planar core 103 adhered to the top end surface 106*d* of the side core 106, such that the planar core 103 is supported only by the side core 106, and an empty space formed as a magnetic gap between the top end surface 105*a* of the center core 105 and the wide surface 103*a*. By thus forming a magnetic gap between the top end surface 105*a* of the center core 105 and the planar core 103, the superimposed direct current characteristics of the inductance element 100 can be improved. It should be noted that the magnetic gap between the top end surface 105*a* of the center core 105 and the wide surface 103*a* may be a so-called spacer gap, formed by sandwiching non-magnetic insulation tape.

A height in the vertical direction of the side core 106 may be made somewhat shorter than the height in the vertical direction of the center core 105, the planar core 103 adhered to the top end surface 105*a* of the center core 105, such that the planar core 103 is supported only by the center core 105, and an empty space formed as a magnetic gap between the top end surface 106*d* of the side core 106 and the wide surface 103*a*. The magnetic gap between the top end surface 106*d* of the side core 106 and the wide surface 103*a* may be a spacer gap.

Figure 4:
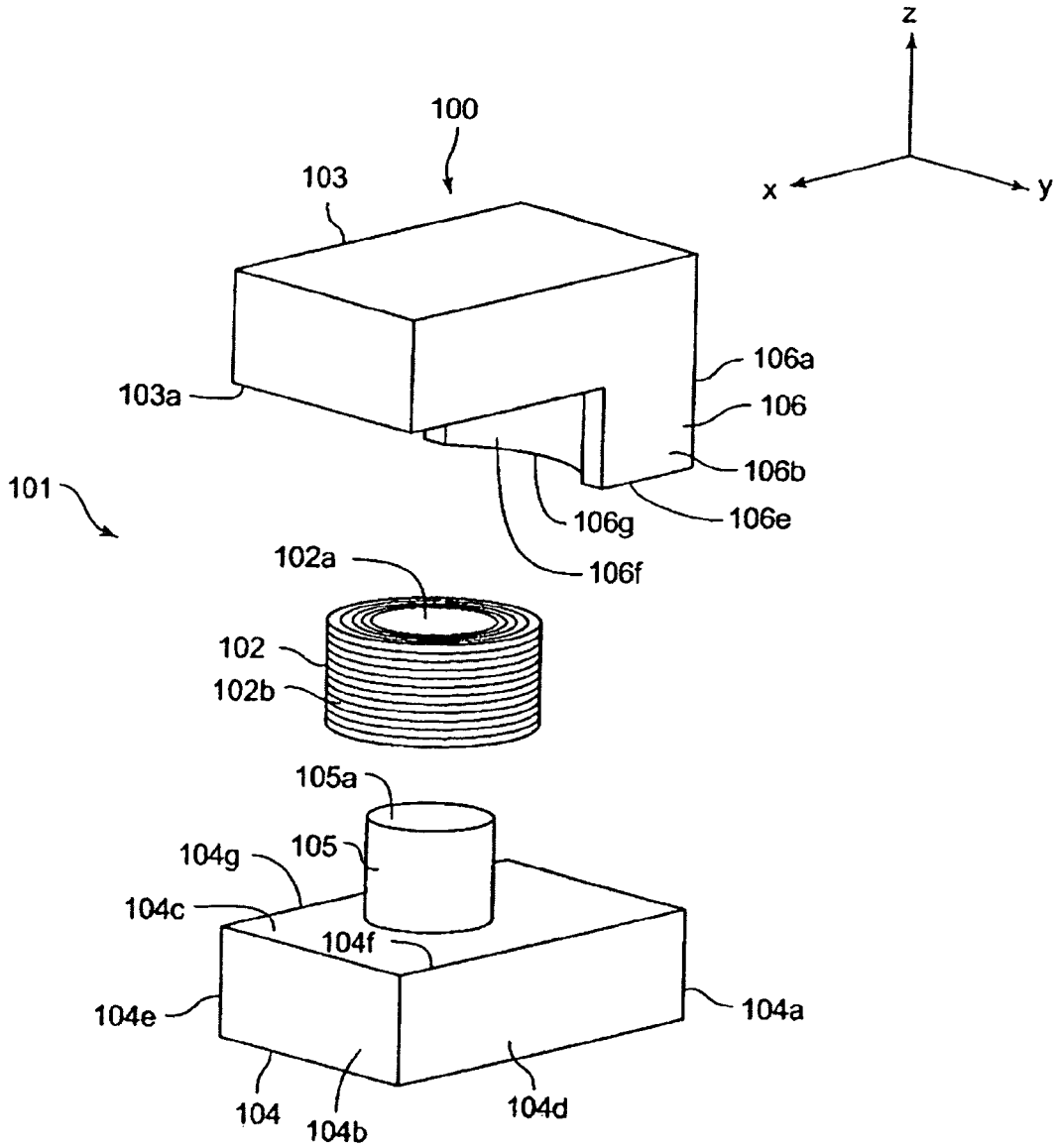
FIG. 4 shows a construction in which only a center core is provided on one planar core, and a side core is provided on another planar core, in the core shown in FIG. 1.

In the configuration shown in FIG. 1 and FIG. 2, both the center core 105 and the side core 106 are provided on one planar core 104. However, as shown in FIG. 4, the center core 105 alone may be mounted on the one planar core 104 and the side core 106 may be mounted on the other planar core 103. In this case, the planar core 104 and the center core 105 are formed into a single integrated unit by sintering, or the like, magnetic powder such as ferrite, and the side core 106 and the planar core 103 are also similarly formed into a single integrated unit by sintering, or the like, magnetic powder such as ferrite. By forming the planar core 104 and the center core 105 into a single integrated unit by sintering or the like, the junction between the planar core 104 and the center core 105 is completely formed into a single integrated unit, enabling leakage magnetic flux to be reduced. Similarly, by forming the side core 106 and the other planar core 103 into a single integrated unit by sintering or the like, the junction between the side core 106 and the planar core 103 is completely formed into a single integrated unit, enabling leakage magnetic flux to be reduced. It should be noted that when both the center core 105 and the side core 106 are formed into a single integrated unit with the one planar core 104 by sintering or the like, similarly, the junctions between the center core 105 and the side core 106 with the planar core 104 are formed completely into single integrated units, thus enabling leakage magnetic flux to be reduced.

Next, the top end surface 105*a* of the center core 105 and the planar core 103 are attached to each other with an adhesive agent, and a bottom end surface of the side core 106 (corresponding to the surface of the portion 106*e* joined to the planar core 104 in FIGS. 1 and 2) and the planar core 104 are also similarly attached to each other with an adhesive agent so as to form the core unit 101. Thus, by adopting a configuration that provides only the center core 105 on the planar core 104, there is no obstruction around the center core 105, and the copper wire can be wound directly onto the center core 105 by machine.

It should be noted that, where, as here also, only the center core 105 is mounted on the planar core 104 and the side core 106 is mounted on the planar core 103 side, by providing a difference in the heights of the center core 105 and the side core 106, an empty space may be formed as a magnetic gap between the top end surface 105*a* of the center core 105 and the planar core 103, or between the bottom end surface of the side core 106 and the planar core 104. The magnetic gap between the top end surface 105*a* of the center core 105 and the planar core 103, or between the bottom end surface of the side core 106 and the planar core 104, may be a spacer gap.

Moreover, in the configuration shown in FIG. 1 and FIG. 2, or in FIG. 4, the center core 105 and the side core 106 are formed as a single integrated unit with one of the planar cores 103 or 104. Alternatively, however, the center core 105, the planar cores 103, 104, and the side core 106 may each be formed separately. In that case, by attaching the center core 105, the planar cores 103, 104, and the side core 106 to each other with an adhesive agent, so that they form a single integrated unit as a whole, the core unit 101 may be constructed. In this case also, by providing a difference in the heights of the center core 105 and the side core 106, an empty space may be formed as a magnetic gap between one end surface of the center core 105 and one of the planar cores 103 or 104, or between one end surface of the side core 106 and one of the planar cores 103 or 104. The magnetic gap may be a spacer gap.

Moreover, at least one of the cores that comprise the core unit 101, namely the planar cores 103, 104, the center core 105 and the side core 106, may be formed by compression-molding of permalloy, Sendust, or other such powder, in a construction that uses a so-called compressed metal powder core. In the compressed metal powder core portion of the core unit 101, the saturation magnetic flux density can be increased, thus enabling the inductance element 100 to be made more compact.

In particular, forming the planar cores 103, 104 by compressed metal powder enables the cross-sectional areas S3 of the planar cores 103, 104 to be decreased, which in turn enables the thicknesses of the planar cores 103, 104 to be reduced. Therefore, the vertical height of the inductance element 100 can be reduced.

Second Embodiment

A description is now given of a magnetic element according to a second embodiment of the present invention.

Figure 5:
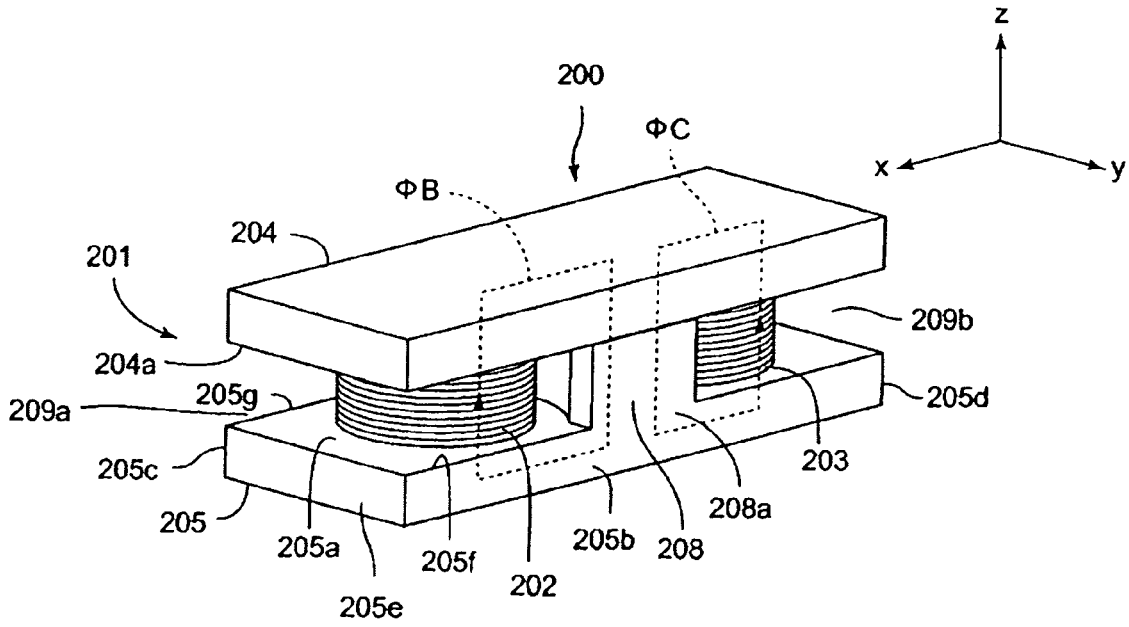
FIG. 5 shows a perspective view of a magnetic element according to a second embodiment of the present invention.
Figure 6:
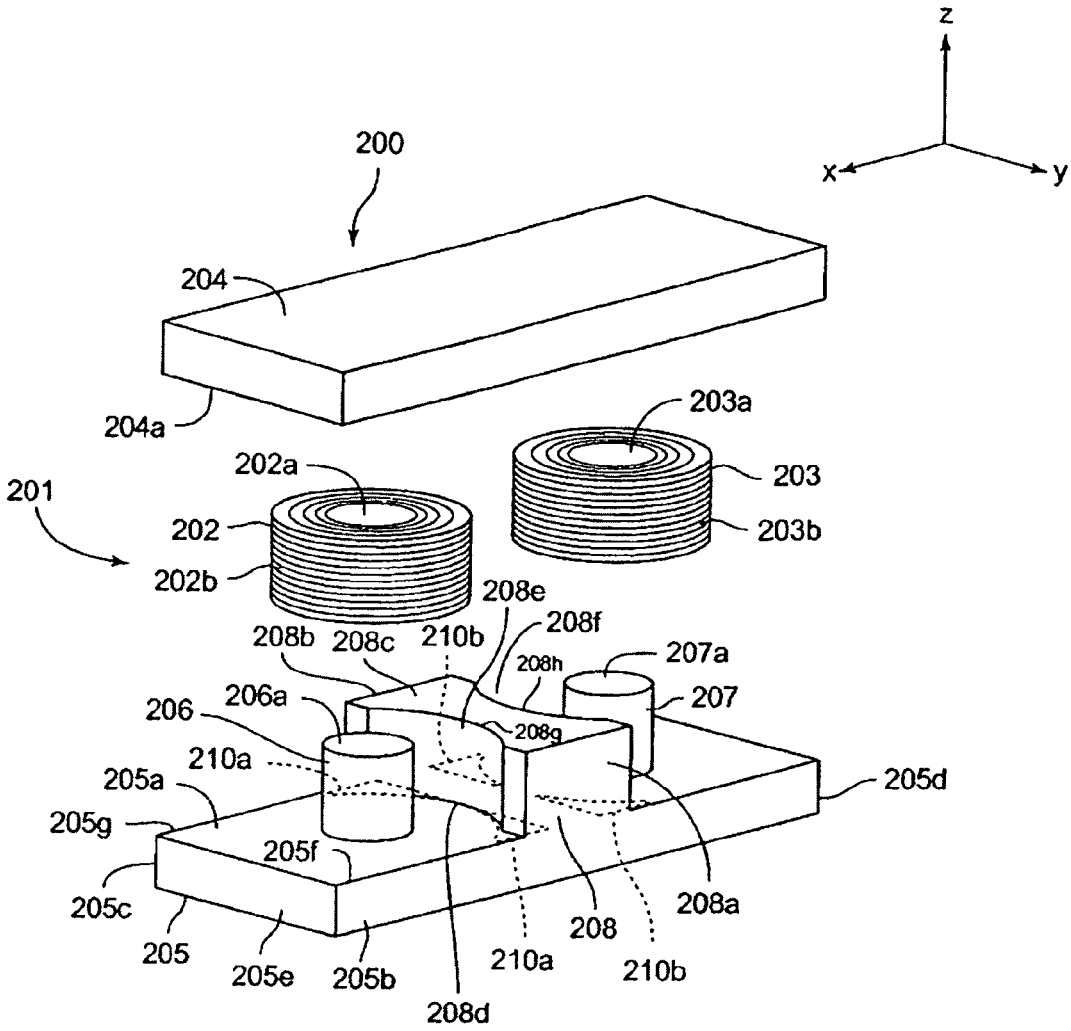
FIG. 6 shows an exploded perspective view of the magnetic element shown in FIG. 5.

FIG. 5 is a perspective view of a magnetic element according to a second embodiment of the present invention. In addition, FIG. 6 shows an exploded perspective view of the magnetic element according to the second embodiment of the present invention. In the following description, as with FIG. 1 through FIG. 3, in the drawings the X-axis direction is front (the front side), the Y-axis direction is left (the left side), and the Z-axis direction is up (the top side).

The inductance element 200 as a magnetic element has a core unit 201 and two coils 202, 203. The core unit 201 has planar cores 204, 205, center cores 206, 207, and a side core 208. The planar cores 204, 205 overall are vertically flattened rectangular bodies, both having substantially the same shape. The center cores 206, 207 are columnar in shape, having their long directions in the vertical direction, and both having substantially the same shape.

The side core 208 is a substantially weight-shaped column in cross-section, in a surface along an X-Y plane. In other words, the side core 208 has lateral side surfaces 208*a*, 208*b* and a top end surface 208*c* that are flat, and recessed portions 208*g*, 208*h* that are curved in the shape of inward-facing arcs are formed in front and rear side surfaces 208*e*, 208*f*. It should be noted that the side core 208 is columnar in shape, and its cross-section has the same shape from a portion 208*d* that joins the planar core 205 to the top end surface to 208*c*.

The planar core 205, the center cores 206, 207, and the side core 208 are formed into a single integrated unit by sintering, or the like, magnetic powder such as ferrite. The center cores 206, 207 and the side core 208 are mounted so as to project upwardly from a wide surface 205*a* on the top side of the planar core 205.

The side core 208 is disposed at a center portion in a longitudinal direction that is also the long direction of the planar core 205. A width of the side core 208 in a lateral direction is the same as a width of the planar core 205 in the lateral direction, and the lateral side surfaces 208*a*, 208*b* are each disposed so as to be flush with lateral long side surfaces 205*b*, 205*c* of the planar core 205. The center cores 206, 207 are each disposed on both proximal and distal sides of the side core 208, at positions substantially at the center between the side core 208 and short side surfaces 205*d*, 205*e* of the planar core 205 that form both end surfaces in the long direction of the planar core 205.

The coils 202, 203 are wound wire coils formed by winding copper wire in a cylindrical shape, having hollow portions 202*a*, 203*a* formed in the inner peripheries thereof. The coils 202, 203 are each set on the planar core 205 by inserting the center cores 206, 207 into the hollow portions 202*a*, 203*a*.

It should be noted that the center cores 206, 207 and the side core 208 are each disposed at positions that secure a distance, such that the side core 208 and the coils 202, 203 do not interfere with each other when the center cores 206, 207 are inserted into the coils 202, 203.

After the center cores 206, 207 are each inserted into the respective coils 202, 203, the wide surface 204*a* of the planar core 204 is placed against top end surfaces 206*a*, 207*a* of the center cores 206, 207 and, the top end surface 208*c* of the side core 208 and the joined surfaces are adhesively fixed in place with an adhesive agent, thus forming the planar cores 204, 205, the side core 208 and the center cores 206, 207 into a single integrated unit so as to form the core unit 201.

Therefore, in the core unit 201, when an electric current is passed through the coil 202, a magnetic field (magnetic flux F B) that passes through the center core 206, the planar core 204, the side core 208, the planar core 205 and the center core 206 is produced. In addition, when an electric current is passed through the coil 203, a magnetic field (magnetic flux F C) that passes through the center core 207, the planar core 204, the side core 208, the planar core 205 and the center core 207 is produced. In other words, the center core 206, the planar core 204, the side core 208, the planar core 205, and the center core 206 form a closed magnetic path. Moreover, the center core 207, the planar core 204, the side core 208, the planar core 205, and the center core also form a closed magnetic path. It should be noted that the direction of the magnetic flux changes with the direction of the electric currents passing through the coils 202, 203.

The side coil 208 is disposed between the center core 206 and the center core 207 that are longitudinally disposed. In other words, the side core 208 is disposed distally of the center core 206 and proximally of the center core 207. Therefore, an open portion 209*a* is formed between the planar core 204 and the planar core 205 in front of and to the lateral sides of the center core 206. In addition, an open portion 209*b* is formed between the planar core 204 and the planar core 205 behind and to the lateral sides of the center core 207. As a result, the ends of the coil 202 can be easily drawn out of the core unit 201 from the open portion 209*a*. Likewise, the ends of the coil 203 also can be easily drawn out of the core unit 201 from the open portion 209*b*.

However, whereas the lateral edges 205*f*, 205*g* of the wide surface 205*a* of the planar core 205 on which the coils 202, 203 are set are straight lines, by contrast, the outer peripheral surfaces of the coils 202, 203 are cylindrical. Therefore, substantially triangular spaces 210*a* whose hypotenuses are arc-shaped are formed as dead spaces between the lateral side surfaces on the rear side of the coil 202 and the edges 205*f*, 205*g*, as indicated by the dotted lines in FIG. 6. Moreover, with coil 203 as well, substantially triangular spaces 210*b* whose hypotenuses are arc-shaped are formed as dead spaces between the lateral side surfaces on the front side of the coil 203 and the edges 205*f*, 205*g*, again as indicated by the dotted lines in FIG. 6.

The recessed portion 208*g* formed in the front side surface 208*e* of the side core 208 is a curved surface, concave in the shape of a concentric arc of greater curve than the outer peripheral surface 202*b* of the coil 202 so as to accommodate the shape of the outer peripheral surface 202*b* of the coil 202. In addition, the recessed portion 208*h* formed in the rear side surface 208*f* of the side core 208 is a curved surface, concave in the shape of a concentric arc of greater curve than the outer peripheral surface 203*b* of the coil 203 so as to accommodate the shape of the outer peripheral surface 203*b* of the coil 203.

In other words, the side core 208 is shaped so as to extend into the spaces 210*a*, 210*b* as the side core 208 extends toward the sides of the side surfaces 208*a*, 208*b* from a lateral center side. A portion of the coil 202 contained in the recessed portion 208*g*, and similarly, a portion of the coil 203 is contained in the recessed portion 208*h*.

As a result, the cross-sectional area of the side core 208, that is, the surface area of the top end surface 208*c*, can be increased without decreasing the space for the disposition of the coils 202, 203 (that is, the so-called winding frame). In other words, the cross-sectional area of the side core 208 can be increased without decreasing the size of the coils 202, 203. Therefore, it results in making it difficult for magnetic saturation of the magnetic fluxes F B. F C passing from the planar core 204 through the side core 208 to the planar core 205 to arise. In addition, because a distance between the center cores 206, 207 and the side core 208 can be secured, the number of windings of the coils 202, 203 can be increased, thus enabling a large inductance value to be obtained. Or, alternatively, the thickness of the winding wire of the coils 202, 203 can be increased, thus aiding direct current resistance reduction.

Moreover, because the side core 208 extends into the spaces 210*a*, 210*b* that are dead spaces, the cross-sectional area of the side core 208 increases. As a result, the mounting surface area of the inductance element 200 is not increased. In other words, in the inductance element 200, the surface areas of the wide surfaces 204*a*, 205*c* of the planar cores 204, 205 are the mounting surface areas. The cross-sectional area of the side core 208 is increased by extending the side core 208 into the spaces 210*a*, 210*b*; therefore, the surface areas of the wide surfaces 204*a*, 205*a* of the planar cores 204, 205 do not increase.

By making a cross-sectional area (surface area of the top end surface 208*c*) S4 of the side core 208, with respect to a cross-sectional area S5 of the center core 206, that is, the surface area of the top end surface 206*a*, or a cross-sectional area S5 of the center core 207, that is, the surface area S5 of the top end surface 207 a, such that $S5+S5 \leqq S4 \leqq =5\times(S5+S5)$, it is possible to effectively make it more difficult for magnetic saturation to occur in the side core 208. In other words, by making the cross-sectional area of the side core 208 from 1 to 5 times the total combined cross-sectional areas of the center core 206 and the center core 207, it is possible to effectively make it more difficult for magnetic saturation to occur in the side core 208.

In addition, by making a cross-sectional area S6 of the vertical cross-section of the planar cores 204, 205, with respect to the cross-sectional area S5 of the center cores 206, 207, such that $S5 \leqq S6 \leqq 5\times S5$, it is possible to effectively make it more difficult for magnetic saturation to occur in the planar cores 204, 205.

If the thicknesses between the center core 206 and the center core 207 are different, then by making the cross-sectional area S6 of the planar cores 204, 205 from 1 to 5 times the cross-sectional area of the thicker of the two winding coils, it is possible to effectively make it more difficult for magnetic saturation to occur in the planar cores 204, 205.

Further, a height in a vertical direction of the center cores 206, 207 may be made somewhat shorter than a height in a vertical direction of the side core 208 (for example, 1 mm shorter), the planar core 204 adhered to the top end surface 208*c* of the side core 208 such that the planar core 204 is supported only by the side core 208, and an empty space formed as a magnetic gap between the top end surface 206*a* of the center core 206 and the top end surface 207*a* of the center core 207 and the wide surface 204*a* on the other. By thus forming a magnetic gap between the top end surfaces 206*a*, 207*a* of the center cores 206, 207 and the planar core 204, the superimposed direct current characteristics of the inductance element 200 can be improved. It should be noted that the magnetic gap between the top end surfaces 206*a*, 207*a* of the center cores 206, 207 and the planar core 204 may be a spacer gap.

A height in the vertical direction of the side core 208 may be made somewhat shorter than the height in the vertical direction of the center cores 206, 207, the planar core 204 adhered to the top end surfaces 206*a*, 207*a* of the center cores 206, 207 such that the planar core 204 is supported only by the center cores 206, 207, and an empty space formed as a magnetic gap between the top end surface 208*c* of the side core 208 and the wide surface 204*a*. The magnetic gap between the top end surface 208*c* of the side core 208 and the wide surface 204*a* may be a spacer gap.

Although in the configuration shown in FIG. 5 and FIG. 6 both the center cores 206, 207 and the side core 208 are provided on the one planar core 205, alternatively, the center cores 206, 207 alone may be provided on the planar core 205 and the side core 208 may be provided on the other planar core 204. In that case, the planar core 205 and the center cores 206, 207 are formed as a single integrated unit by sintering, or the like, magnetic powder such as ferrite, and the side core 208 and the planar core 204 are similarly formed as a single integrated unit by sintering, or the like, magnetic powder such as ferrite.

Next, the top end surfaces 206*a*, 207*a* of the center cores 206, 207 and the planar core 204 are attached to each other with an adhesive agent, and the bottom end surface of the side core 208 (the surface that corresponds to the portion that attaches to the planar core 205 in FIG. 5 and FIG. 6) and the planar core 205 are similarly attached to each other with an adhesive agent so as to form the core unit 201.

It should be noted that where, as described above, only the center cores 206, 207 are provided on the planar core 205, and the side core 208 is mounted on the planar core 204 side, in this case also, by providing a difference in the heights of the center cores 206, 207 and the side core 208, an empty space may be formed as a magnetic gap between the top end surfaces 206*a*, 207*a* of the center cores 206, 207 and the planar core 204, or between the bottom end surface of the side core 208 and the planar core 205. The magnetic gap between the top end surfaces 206*a*, 207*a* of the center cores 206, 207 and the planar core 204, or between the bottom end surface of the side core 208 and the planar core 205 may be a spacer gap.

Moreover, although in the configuration shown in FIG. 5 and FIG. 6, the center cores 206, 207, the side core 208 and the planar core 205 are formed as a single integrated unit, alternatively, the center cores 206, 207, the planar core 205 and the side core 208 may each be formed separately. In that case, by attaching the center cores 206, 207, the planar cores 204, 205, and the side core 208 to each other with an adhesive agent, as a whole they form the core unit 201 constituted as a single integrated unit. In this case also, by providing a difference in the heights of the center cores 206, 207 and the side core 208, an empty space may be formed as a magnetic gap between one end surface of the center cores 206, 207 and one of the planar cores 204 or 205, or between one end surface of the side core 208 and one of the planar cores 204 or 205. The magnetic gap may be a spacer gap.

Moreover, at least one of the cores that comprise the core unit 201, namely the planar cores 204, 205, the center cores 206, 207, and the side core 208, may be formed by compression-molding of permalloy, Sendust, or other such powder, in a construction that uses a so-called compressed metal powder core. In the compressed metal powder core portion of the core unit 201 the saturation magnetic flux density can be increased, thus enabling the inductance element 200 to be made more compact.

In particular, forming the planar cores 204, 205 of compressed metal powder enables the cross-sectional areas S6 of the planar cores 204, 205 to be decreased, which in turn enables the thicknesses of the planar cores 204, 205 to be reduced. Therefore, the vertical height of the inductance element 200 can be reduced.

Third Embodiment

A description is now given of a magnetic element according to a third embodiment of the present invention.

Figure 7:
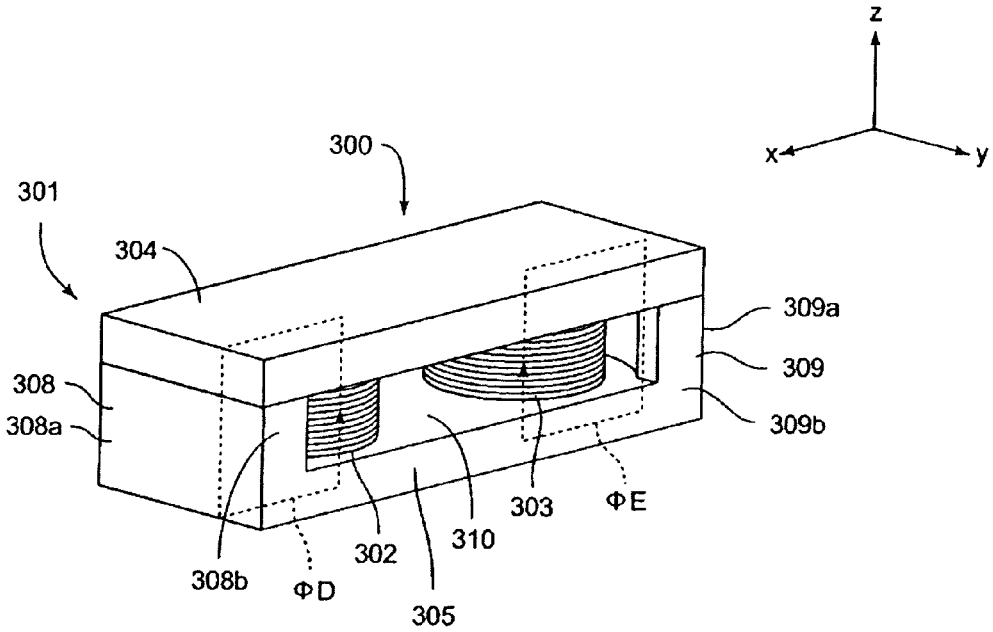
FIG. 7 shows a perspective view of a magnetic element, according to a third embodiment of the present invention.
Figure 8:
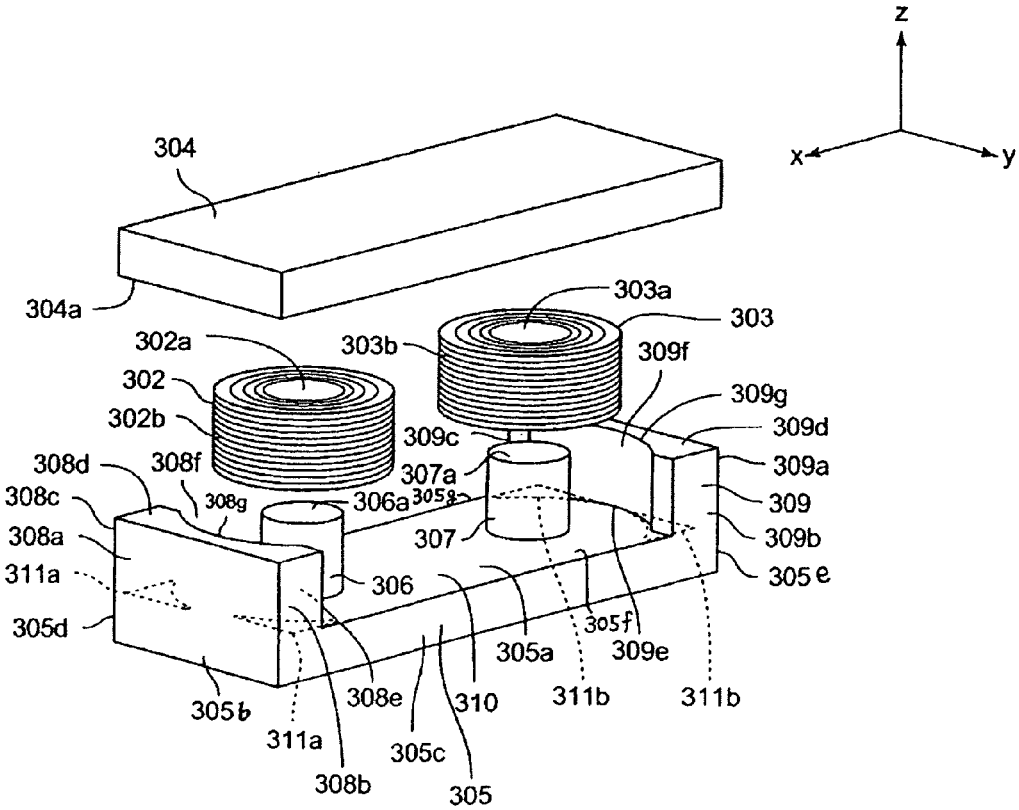
FIG. 8 shows an exploded perspective view of the magnetic element shown in FIG. 7.

FIG. 7 is a perspective view of the magnetic element according to the third embodiment of the present invention. In addition, FIG. 8 is an exploded perspective view of the magnetic element according to the third embodiment of the present invention. In the following description, as with FIG. 1 through FIG. 3, in the drawings the X-axis direction is front (the front side), the Y-axis direction is left (the left side), and the Z-axis direction is up (the top side).

The inductance element 300 as a magnetic element has a core unit 301 and two coils 302, 303. The core unit 301 has planar cores 304, 305, center cores 306, 307, and side cores 308, 309. The planar cores 304, 305 overall are vertically flattened rectangular bodies, both having substantially the same shape. The center cores 306, 307 are columnar in shape, having their long directions in the vertical direction, and both having substantially the same shape.

The side cores 308, 309 are mounted on both ends of the planar core 305 in a longitudinal direction, which is the long direction, of the planar core 305. Moreover, the side cores 308, 309 are substantially saddle-shaped columns in cross-section, in a surface along an X-Y plane. In other words, the side core 308 has a front side surface 308*a*, lateral side surfaces 308*b*, 308*c* and a top end surface 308*d* that are flat, and a recessed portion 308*g* that is curved in the shape of an inward- (front-) facing arc is formed in a rear side surface 308*f*. In addition, side core 309 similarly has a rear side surface 309*a*, lateral side surfaces 309*b*, 309*c* and a top end surface 309*d* that are flat, and a recessed portion 309*g* that is curved in the shape of an inward- (rear-) facing arc is formed in a front side surface 309*f*. It should be noted that the side core 308 is columnar in shape, and its cross-section has the same shape from a portion 308*e* that joins the planar core 305 to the top end surface to 308*d*. The side core 309 also is columnar in shape, and its cross-section has the same shape from a portion 309*e* that joins the planar core 305 to the top end surface 309*d*.

The planar core, 305, the center cores 306, 307, and the side cores 308, 309 are formed into a single integrated unit by sintering, or the like, magnetic powder such as ferrite. The center cores 306, 307 and the side cores 308, 309 are each mounted so as to project upwardly from a wide surface 305*a* on the top side of the planar core 305.

The side core 308 and the center core 306, and the side core 309 and the center core 307, in their positions and their shapes, are arranged symmetrically about a center of the planar core 305 in the longitudinal direction of the planar core 305.

The side core 308 is disposed on where its front side surface 308*a* is flush with a short side surface 306*a* that forms one end surface in the long direction of the planar core 305 on the front side of the wide surface 305*a* of the planar core 305. Moreover, a width of the side core 308 in a lateral direction is the same as a width of the planar core 305 in the lateral direction. Lateral side surfaces 308*b*, 308*c* of the side core 308 are each disposed so as to be flush with lateral long side surfaces 305*c*, 305*d* of the planar core 305.

By contrast, the side core 309 is disposed on where its rear side surface 309*a* is flush with a short side surface 305*e* that forms the other end surface in the long direction of the planar core 305 on the rear side of the wide surface 305*a* of the planar core 305. Moreover, a width of the side core 309 in the lateral direction is the same as the width of the planar core 305 in the lateral direction. Lateral side surfaces 309*b*, 309*c* of the side core 309 are each disposed so as to be flush with the lateral long side surfaces 305*c*, 305*d* of the planar core 305.

The center core 306 is disposed at substantially the center between the center of the planar core 305 in the longitudinal direction and the side core 308. In addition, the center core 307 is also disposed at substantially the center between the center of the planar core 305 in the longitudinal direction and the side core 309.

The coils 302, 303 are wound wire coils formed by winding copper wire in a cylindrical shape, having hollow portions 302*a*, 303*a* formed in the inner peripheries thereof. The coils 302, 303 are each set on the planar core 305 by inserting the center cores 306, 307 into the hollow portions 302*a*, 303*a*.

It should be noted that the center cores 306, 307 and the side cores 308, 309 are each disposed at positions that secure a distance, such that the side cores 308, 309 and the coils 302, 303 do not interfere with each other, or the coils 302, 303 themselves do not interfere with each other, when the center cores 306, 307 are inserted into the coils 302, 303. In other words, the center core 306 and the center core 307 are mounted a predetermined distance apart so that the coils 302, 303 do not interfere with each other. Moreover, the center cores 306, 307 and the side cores 308, 309 are also mounted a predetermined distance apart so that the coils 302, 303 do not interfere with the side cores 308, 309.

After the center cores 306, 307 are each inserted into the respective coils 302, 303, the wide surface 304*a* of the planar core 304 is placed against top end surfaces 306*a*, 307*a* of the center cores 306, 307 and the top end surfaces 308*d*, 309*d* of the side cores 308, 309 and the joined surfaces are adhesively fixed in place with an adhesive agent, thus forming the planar cores 304, 305, the side cores 308, 309 and the center cores 306, 307 into a single integrated unit so as to form the core unit 301.

Therefore, in the core unit 301, when an electric current is passed through the coil 302, a magnetic field (magnetic flux F D) that passes through the center core 306, the planar core 304, the side core 308, the planar core 305 and the center core 306 is produced. In addition, when an electric current is passed through the coil 303, a magnetic field (magnetic flux F E) that passes through the center core 307, the planar core 304, the side core 309, the planar core 305 and the center core 307 is produced. In other words, the center core 306, the planar core 304, the side core 308, the planar core 305, and the center core 306 form a closed magnetic path. Moreover, the center core 307, the planar core 304, the side core 309, the planar core 305, and the center core 307 also form a closed magnetic path. It should be noted that the direction of the magnetic flux changes with the direction of the electric currents passing through the coils 302, 303.

The side cores 308, 309 are disposed in the longitudinal direction of the planar cores 304, 305, sandwiching the center cores 306, 307 therebetween. Therefore, an open portion 310 is formed between the planar core 304 and the planar core 305 and to the lateral sides of the center cores 306, 307. As a result, the ends of the coils 302, 303 can be easily drawn out of the core unit 301 from the open portion 310.

However, whereas the lateral edges 305*f*, 305*g* of the wide surface 305*a* of the planar core 305 on which the coils 302, 303 are set are straight lines, by contrast, the outer peripheral surfaces of the coils 302, 303 are cylindrical. Therefore, substantially triangular spaces 311*a* whose hypotenuses are arc-shaped are formed as dead spaces between the lateral side surfaces on the front side of the coil 302 and the edges 305*f*, 305*g*, as indicated by the dotted lines in FIG. 8. Moreover, with coil 303 as well, substantially triangular spaces 311*b* whose hypotenuses are arc-shaped are formed as dead spaces between the lateral side surfaces on the rear side of the coil 303 and the edges 305*f*, 305*g*, again as indicated by the dotted lines in FIG. 8.

The recessed portion 308*g* formed in the rear side surface 308*f* of the side core 308 is a curved surface, concave in the shape of a concentric arc of greater curve than the outer peripheral surface 302*b* of the coil 302 so as to accommodate the shape of the outer peripheral surface 302*b* of the coil 302. In other words, the side core 308 is shaped so as to extend into the spaces 311*a* as the side core 308 extends toward the sides of the side surfaces 308*b*, 308*c* from a lateral center side, with a portion of the coil 302 contained in the recessed portion 308*g*. As a result, the cross-sectional area of the side core 308, that is, the surface area of the top end surface 308*d*, can be increased without decreasing the winding frame for the disposition of the coil 302.

Similarly, with the side core 309 as well, the recessed portion 309*g* formed in the front side surface 309*f* of the side core 309 is a curved surface, concave in the shape of a concentric arc of greater curve than the outer peripheral surface 303*b* of the coil 303 so as to accommodate the shape of the outer peripheral surface 303*b* of the coil 303. In other words, the side core 309 is shaped so as to extend into the spaces 311*b* as the side core 309 extends toward the sides of the side surfaces 309*b*, 309*c* from a lateral center side, with a portion of the coil 303 contained in the recessed portion 309*g*. As a result, the cross-sectional area of the side core 309 as well, that is, the surface area of the top end surface 309*d*, can be increased without decreasing the winding frame for the disposition of the coil 303. In other words, the cross-sectional area of the side cores 308, 309 can be increased without decreasing the size of the coils 302, 303. Therefore, it results in making it difficult for magnetic saturation of the magnetic flux F D passing from the planar core 304 through the side core 308 to the planar core 305 to arise. Similarly, it results in making it difficult for magnetic saturation of the magnetic flux F E passing from the planar core 304 through the side core 309 to the planar core 305 to arise. In addition, because a distance can be secured between the center core 306 and the side core 308, as well as between the center core 307 and the side core 309, the number of windings of the coils 302, 303 can be increased, thus enabling a large inductance value to be obtained. Or, alternatively, the thickness of the winding wire of the coils 302, 303 can be increased, thus aiding direct current resistance reduction.

The side cores 308, 309 extend into the spaces 311*a*, 311*b* that are dead spaces, and therefore their cross-sectional area increases. As a result, the mounting surface area of the inductance element 300 is not increased. In other words, in the inductance element 300, the surface areas of the wide surfaces 304*a*, 305*a* of the planar cores 304, 305 are the mounting surface areas. By extending the side cores 308, 309 into the spaces 311*a*, 311*b*, the cross-sectional area of the side cores 308, 309 is increased, and therefore the surface areas of the wide surfaces 304*a*, 305*a* of the planar cores 304, 305 do not increase.

By making a cross-sectional area (the surface area of top end surfaces 308*d*, 309*d*) S7 of the side cores 308, 309, with respect to a cross-sectional area S8 of the center cores 306, 307, that is, the surface area of the top end surfaces 306*a*, 307*a*, such that $S8 \leqq S7 \leqq 5 \times S8$, it is possible to effectively make it more difficult for magnetic saturation to occur in the side cores 308, 309.

In addition, by making a cross-sectional area S9 of the vertical cross-section of the planar cores 304, 305, with respect to the cross-sectional area S8 of the center cores 306, 307, such that $S8 \leqq S9 \leqq 5 \times S8$, it is possible to effectively make it more difficult for magnetic saturation to occur in the planar cores 304, 305.

If the thicknesses of the center core 306 and the center core 307 are different, then by making the cross-sectional area S9 of the planar cores 304, 305 from 1 to 5 times the cross-sectional area of the thicker of the two winding coils it is possible to effectively make it more difficult for magnetic saturation to occur in the planar cores 304, 305.

Further, a height in a vertical direction of the center cores 306, 307 may be made somewhat shorter than a height in a vertical direction of the side cores 308, 309 (for example, 1 mm shorter), the planar core 304 adhered to the top end surfaces 308*d*, 309*d* of the side cores 308, 309 such that the planar core 304 is supported only by the side cores 308, 309, and an empty space formed as a magnetic gap between the top end surfaces 306*a*, 307*a* of the center cores 306, 307, on the one hand, and the wide surface 304*a* on the other. By thus forming a magnetic gap between the top end surfaces 306*a*, 307*a* of the center cores 306, 307 and the planar core 304, the superimposed direct current characteristics of the inductance element 300 can be improved. It should be noted that the magnetic gap between the top end surfaces 306*a*, 307*a* of the center cores 306, 307 and the planar core 304 may be a spacer gap.

A height in the vertical direction of the side cores 308, 309 may be made somewhat shorter than the height in the vertical direction of the center cores 306, 307, the planar core 304 adhered to the top end surfaces 306*a*, 307*a* of the center cores 306, 307 such that the planar core 304 is supported only by the center cores 306, 307, and an empty space formed as a magnetic gap between the top end surfaces 308*d*, 309*d* of the side cores 308, 309 and the wide surface 304*a*. The magnetic gap between the top end surfaces 308*d*, 309*d* of the side cores 308, 309 and the wide surface 304*a* may be a spacer gap.

Although in the configuration shown in FIG. 7 and FIG. 8, both the center cores 306, 307 and the side cores 308, 309 are mounted on the one planar core 305, alternatively, the center cores 306, 307 alone may be mounted on the planar core 305 and the side cores 308, 309 may be mounted on the other planar core 304. In that case, the planar core 305 and the center cores 306, 307 are formed as a single integrated unit by sintering, or the like, magnetic powder such as ferrite, and the side cores 308, 309 and the planar core 304 are similarly formed as a single integrated unit by sintering, or the like, magnetic powder such as ferrite.

Next, the top end surfaces 306*a*, 307*a* of the center cores 306, 307 and the planar core 304 are attached to each other with an adhesive agent, and the bottom end surfaces of the side cores 308, 309 (the surfaces that correspond to the portions 308*e*, 309*e* that attach to the planar core 305 in FIG. 7 and FIG. 8) and the planar core 305 are similarly attached to each other with an adhesive agent so as to form the core unit 301.

It should be noted that where, as described above, only the center cores 306, 307 are provided on the planar core 305, and the side cores 308, 309 are mounted on the planar core 304 side, in this case also, by providing a difference in the heights of the center cores 306, 307 and the side cores 308, 309, an empty space may be formed as a magnetic gap between the top end surfaces 306*a*, 307*a* of the center cores 306, 307 and the planar core 304, or between the respective bottom end surfaces of the side cores 308, 309 and the planar core 305. The magnetic gap between the top end surfaces 306*a*, 307*a* of the center cores 306, 307 and the planar core 304, or between the respective bottom end surfaces of the side cores 308, 309 and the planar core 305, may be a spacer gap.

Moreover, although in the configuration shown in FIG. 7 and FIG. 8 the center cores 306, 307, the side cores 308, 309, and the planar core 305 are formed as a single integrated unit, alternatively, the center cores 306, 307, the side cores 308, 309, and the planar core 305 may be each formed separately. In that case, by attaching the center cores 306, 307, the planar cores 304, 305, and the side cores 308, 309 to each other with an adhesive agent, as a whole they form the core unit 301 constituted as a single integrated unit. In this case also, by providing a difference in the heights of the center cores 306, 307 and the side cores 308, 309, an empty space may be formed as a magnetic gap between one end surface of the center cores 306, 307 and one of the planar cores 304 or 305, or between one end surface of the side cores 308, 309 and one of the planar cores 304 or 305. The magnetic gap may be a spacer gap.

Moreover, at least one of the cores that comprise the core unit 301, namely the planar cores 304, 305, the center cores 306, 307, and the side cores 308, 309, may be formed by compression-molding of permalloy, Sendust, or other such powder, in a construction that uses a so-called compressed metal powder core. In the compressed metal powder core portion of the core unit 301, the saturation magnetic flux density can be increased, thus enabling the inductance element 300 to be made more compact.

In particular, forming the planar cores 304, 305 of compressed metal powder enables the cross-sectional areas S9 of the planar cores 304, 305 to be decreased, which in turn enables the thicknesses of the planar cores 304, 305 to be reduced. Therefore, the vertical height of the inductance element 300 can be reduced.

Fourth Embodiment

A description is now given of a magnetic element according to a fourth embodiment of the present invention.

Figure 9:
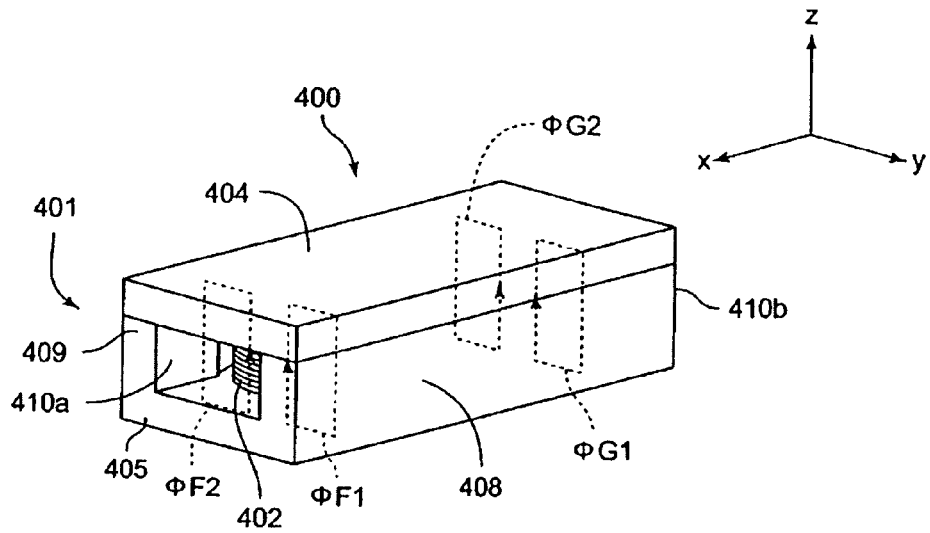
FIG. 9 shows a perspective view of a magnetic element, according to a fourth embodiment of the present invention.
Figure 10:
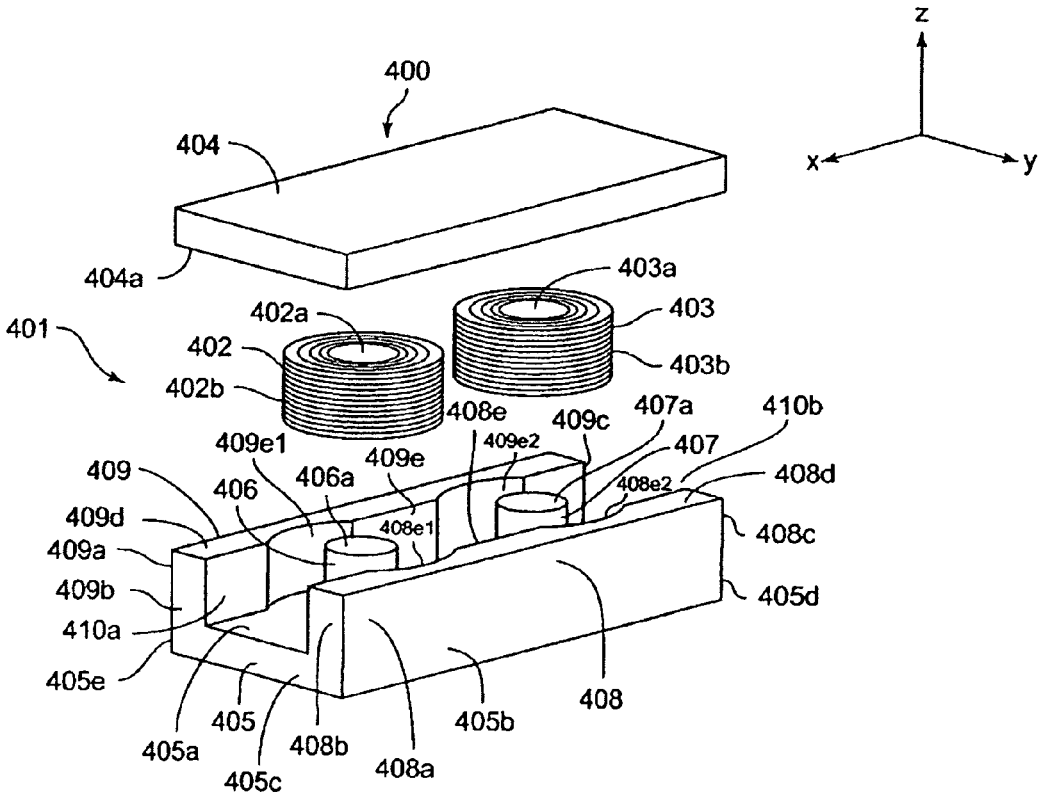
FIG. 10 shows an exploded perspective view of the magnetic element shown in FIG. 9.
Figure 11A:
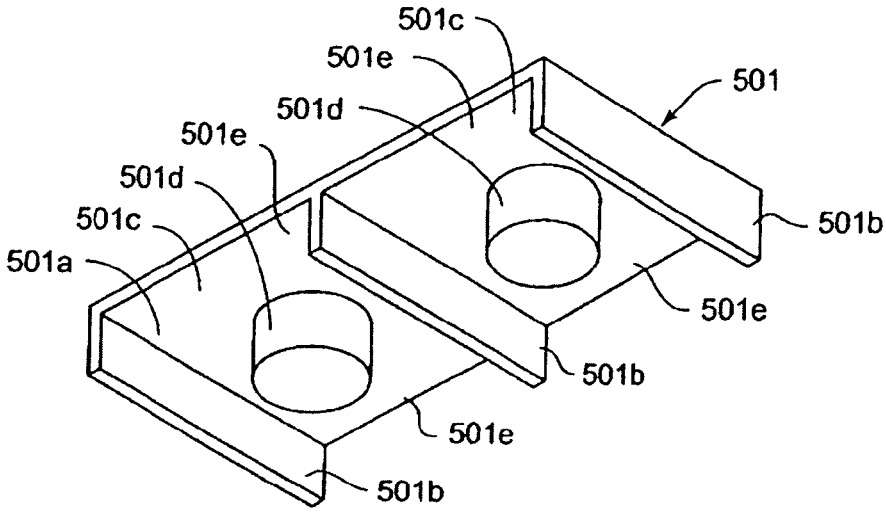
FIGS. 11A-11C show a configuration of the conventional art.
Figure 11B:
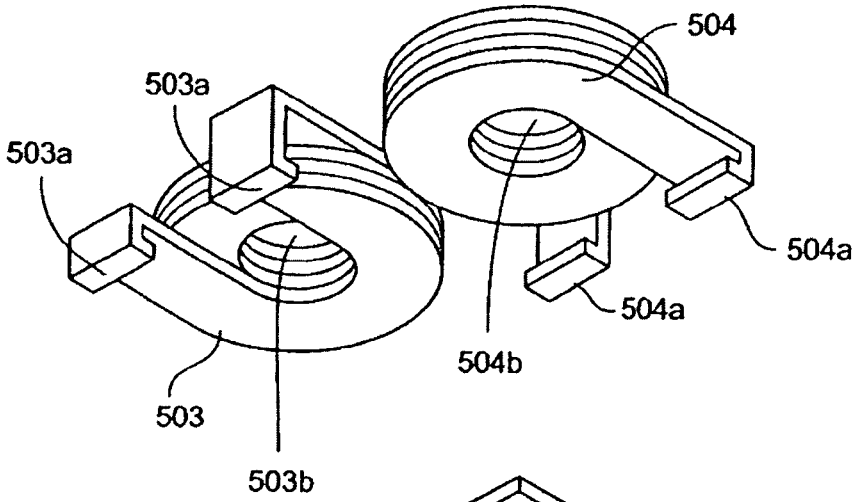
Figure 11C:
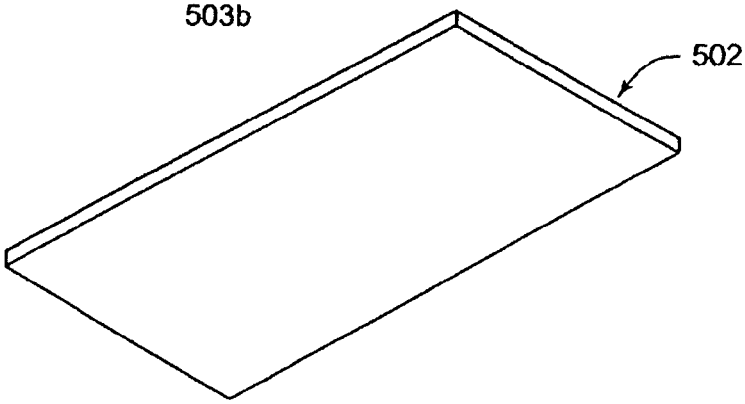

FIG. 9 is a perspective view of the magnetic element according to a fourth embodiment of the present invention. FIG. 10 is an exploded perspective view of the magnetic element according to the fourth embodiment of the present invention. In the following description, as with FIG. 1 through FIG. 3, in the drawings the X-axis direction is front (the front side), the Y-axis direction is left (the left side), and the Z-axis direction is up (the top side).

The inductance element 400 as a magnetic element has a core unit 401 and two coils 402, 403. The core unit 401 has planar cores 404, 405, center cores 406, 407, and side cores 408, 409. The planar cores 404, 405 overall are vertically flattened rectangular bodies, both having substantially the same shape. The center cores 406, 407 are columnar in shape, with their long directions in the vertical direction, and both have substantially the same shape.

The side cores 408, 409 are long and narrow in a longitudinal direction, and overall are substantially quadrangular columns.

The center cores 406, 407, the planar core 405 and the side cores 408, 409 are formed into a single integrated unit by sintering, or the like, magnetic powder such as ferrite. The side cores 408, 409 and the center cores 406, 407 are each mounted so as to project upwardly from a wide surface 405*a* on a top side of the planar core 405.

The side cores 408, 409 are mounted on both lateral ends of the planar core 405, which is the short direction of the planar core 405. Then, a left side surface 408*a* and front and rear end surfaces 408*b*, 408*c* of the side core 408 are flush with a left side surface 405*b*, which is one end surface in the short direction of the planar core 405, and front and rear end surfaces 405*c*, 405*d* of the planar core 405, respectively. With the side core 409 as well, a right side surface 409*a* and front and rear end surfaces 409*b*, 409*c* are flush with a right side surface 405*e*, which is the other end surface in the short direction of the planar core 405, and the front and rear end surfaces 405*c*, 405*d*, respectively.

The coils 402, 403 are wound wire coils formed by winding copper wire in a cylindrical shape, with hollow portions 402*a*, 403*a* formed in the inner peripheries thereof. The coils 402, 403 are each set on the planar core 405 by inserting the center cores 406, 407 into the hollow portions 402*a*, 403*a*.

The center cores 406, 407 are disposed in a direction alongside the side cores 408, 409, that is, parallel to the side cores 408, 409. In addition, the center cores 406, 407 are disposed at positions that secure a distance therebetween, such that, when the winding cores 406, 407 are inserted into the coils 402, 403, the side cores 408, 409 and the coils 402, 403 do not interfere with each other, or the coils 402, 403 do not interfere with each other. In other words, the center core 406 and the center core 407 are mounted a predetermined distance apart, such that the coils 402, 403 do not interfere with each other, and moreover, the center cores 406, 407 and the side cores 408, 409 are also mounted a predetermined distance apart, such that the coils 402, 403 do not interfere with the side cores 408, 409.

After the center cores 406, 407 are each inserted into the respective coils 402, 403, the wide surface 404*a* of the planar core 404 is placed against top end surfaces 406*a*, 407*a* of the center cores 406, 407 and the top end surfaces 408*d*, 409*d* of the side cores 408, 409 and the joined surfaces are adhesively fixed in place with an adhesive agent, thus forming the planar cores 404, 405, the side cores 408, 409, and the center cores 406, 407 into a single integrated unit so as to form the core unit 401.

Therefore, when an electric current is passed through the coil 402, a magnetic field (magnetic flux F F1) that passes through the center core 406, the planar core 404, the side core 408, the planar core 405 and the center core 406, and a magnetic field (magnetic flux F F2) that passes through the center core 406, the planar core 404, the side core 409, the planar core 405 and the center core 406, are produced.

Moreover, when an electric current is passed through the coil 403, a magnetic field (magnetic flux F G1) that passes through the center core 407, the planar core 404, the side core 408, the planar core 405 and the center core 407, and a magnetic field (magnetic flux F G2) that passes through the center core 407, the planar core 404, the side core 409, the planar core 405 and the center core 407, are produced.

In other words, the center core 406, the planar core 404, the side core 408, the planar core 405, and the center core 406, as well as the center core 406, the planar core 404, the side core 409, the planar core 405, and the center core 406 both form closed magnetic paths. Moreover, the center core 407, the planar core 404, the side core 408, the planar core 405 and the center core 407, as well as the center core 407, the planar core 404, the side core 409, the planar core 405 and the center core 407, both form closed magnetic paths. It should be noted that the direction of the magnetic flux changes with the direction of the electric current passing through the coils 402, 403.

The side cores 408, 409 are mounted laterally of the center cores 406, 407. Therefore, an open portion 410*a* is formed in front of the center core 406, between the planar core 404 and the planar core 405. In addition, an open portion 410*b* is also formed behind the center core 407, between the planar core 404 and the planar core 405. As a result, the ends of the coil 402 can be easily drawn out of the core unit 401 from the open portion 410*a*, and similarly, the ends of the coil 403 can be easily drawn out of the core unit 401 from the open portion 410*b*.

However, in inside surfaces 408*e*, 409*e* of the side cores 408, 409, which are surfaces on sides of the side cores 408, 409 that face the coils 402, 403, at portions disposed opposite the coils 402, 403, recessed portions 408*e*1, 408*e*2, 409*e*1, 409*e*2 are formed that are curved surfaces, concave in the shape of concentric arcs of greater curve than the outer peripheral surface 402*b*, 403*b* of the coils 402, 403 so as to accommodate the shape of the outer peripheral surfaces 402*b*, 403*b* of the coils 402, 403. Portions of the coil 402 are contained within the recessed portions 408*e*1 and 409*e*1. Similarly, portions of the coil 403 are contained within the recessed portions 408*e*2 and 409*e*2.

As a result, a lateral thickness of the side cores 408, 409 can be thickened in a direction from lateral side surfaces 405*b*, 405*e* of the planar core 405 side toward the coils 402, 403 without interfering with the coils 402, 403. In other words, a cross-sectional area of the side cores 408, 409, that is, the surface area of the top end surfaces 408*d*, 409*d*, can be increased without decreasing the space (the winding frame) for the winding of the coils 402, 403. In other words, the cross-sectional area of the side cores 408, 409 can be increased without decreasing the size of the coils 402, 403. Therefore, it results in making it difficult for magnetic saturation in the side cores 408, 409 to arise. In addition, because a distance can be secured between the center cores 406, 407 and the side cores 408, 409, the number of windings of the coils 402, 403 can be increased, thus enabling a large inductance value to be obtained. Or, alternatively, the thickness of the winding wire of the coils 402, 403 can be increased, thus aiding direct current resistance reduction.

Moreover, the recessed portions 408*e*1, 408*e*2, 409*e*1, 409*e*2 allow the side cores 408, 409 to be made thicker on the inside of the lateral direction of the planar cores 404, 405 while avoiding a reduction in the winding frame. As a result, the mounting surface area of the inductance element 400 is not increased even if the cross-sectional area of the side cores 408, 409 is increased. In other words, in the inductance element 400, the surface areas of the wide surfaces 404*a*, 405*a* of the planar cores 404, 405 are the mounting surface areas. Because the thicknesses of the side cores 408, 409 are increased in the lateral direction toward the coils 402, 403, surface areas of the wide surfaces 404*a*, 405*a* of the planar cores 404, 405 are not increased.

By making a cross-sectional area (the surface area of top end surfaces 408*d*, 409*d*) S10 of the side cores 408, 409, with respect to a cross-sectional area S11 of the center core 406, that is, the surface area of the top end surface 406*a*, or to across-sectional area S11 of the center core 407, that is, the surface area of the top end surface 407*a*, such that $S11+S11 \leqq S10 \leqq 5\times(S11+S11)$, it is possible to effectively make it more difficult for magnetic saturation to occur in the side cores 408, 409.

In addition, by making a cross-sectional area S12 of the vertical cross-section of the planar cores 404, 405, with respect to the cross-sectional area S11 of the center cores 406, 407, such that $S11 \leqq S12 \leqq 5\times S11$, it is possible to effectively make it more difficult for magnetic saturation to occur in the planar cores 404, 405.

If the thicknesses of the center core 406 and the center core 407 are different, then by making the cross-sectional area S10 of the side cores 408, 409 from 2 to 10 times the cross-sectional area of the thicker of the two center cores, it is possible to effectively make it more difficult for magnetic saturation to occur in the side cores 408, 409.

Moreover, by making the cross-sectional area S12 of the planar cores 404, 405 from 1 to 5 times the cross-sectional area of the thicker of the two center cores, it is possible to effectively make it more difficult for magnetic saturation to occur in the planar cores 404, 405.

Further, a height in a vertical direction of the center cores 406, 407 may be made somewhat shorter than a height in a vertical direction of the side cores 408, 409 (for example, 1 mm shorter), the planar core 404 adhered to the top end surfaces 408*d*, 409*d* of the side cores 408, 409 such that the planar core 404 is supported only by the side cores 408, 409, and an empty space formed as a magnetic gap between the top end surfaces 406*a*, 407*a* of the center cores 406, 407, on the one hand, and the wide surface 404*a* on the other. By thus forming a magnetic gap between the top end surfaces 406*a*, 407*a* of the center cores 406, 407 and the planar core 404, the superimposed direct current characteristics of the inductance element 400 can be improved. It should be noted that the magnetic gap between the top end surfaces 406*a*, 407*a* of the center cores 406, 407 and the planar core 404 may be a spacer gap.

It should be noted that the height in the vertical direction of the side cores 408, 409 may be made somewhat shorter than the height in the vertical direction of the center cores 406, 407, the planar core 404 adhered to the top end surfaces 406*a*, 407*a* of the center cores 406, 407 such that the planar core 404 is supported only by the center cores 406, 407, and an empty space formed as a magnetic gap between the top end surfaces 408*d*, 409*d* of the side cores 408, 409 and the wide surface 404*a*. The magnetic gap between the top end surfaces 408*d*, 409*d* of the side cores 408, 409 and the wide surface 404*a* may be a spacer gap.

Although in the configuration shown in FIG. 9 and FIG. 10 both the center cores 406, 407 and the side cores 408, 409 are mounted on the one planar core 405, alternatively, the center cores 406, 407 alone may be mounted on the planar core 405 and the side cores 408, 409 may be mounted on the other planar core 404. In that case, the planar core 405 and the center cores 406, 407 are formed as a single integrated unit by sintering, or the like, magnetic powder such as ferrite, and the side cores 408, 409 and the planar core 404 are similarly formed as a single integrated unit by sintering, or the like, magnetic powder such as ferrite.

Next, the top end surfaces 406*a*, 407*a* of the center cores 406, 407 and the planar core 404 are attached to each other with an adhesive agent, and the bottom end surfaces of the side cores 408, 409 (the surfaces that are the portions joined to the planar core 405 in FIG. 9 and FIG. 10) and the planar core 405 are similarly attached to each other with an adhesive agent, so as to form the core unit 401.

It should be noted that where, as described above, only the center cores 406, 407 are provided on the planar core 405, and the side cores 408, 409 are mounted on the planar core 404 side, in this case also, by providing a difference in the heights of the center cores 406, 407 and the side cores 408, 409, an empty space may be formed as a magnetic gap between the top end surfaces 406*a*, 407*a* of the center cores 406, 407 and the planar core 404, or between the bottom end surfaces of the side cores 408, 409 and the planar core 405. The magnetic gap between the top end surfaces 406*a*, 407*a* of the center cores 406, 407 and the planar core 404, or between the bottom end surfaces of the side cores 408, 409 and the planar core 405, may be a spacer gap.

Moreover, although in the configuration shown in FIG. 9 and FIG. 10 the center cores 406, 407, the planar core 405, and the side cores 408, 409 are shown formed as a single integrated unit, alternatively, the center cores 406, 407, the planar core 405 and the side cores 408, 409 may be each formed separately. In that case, by attaching the center cores 406, 407, the planar cores 404, 405, and the side cores 408, 409 to each other with an adhesive agent, as a whole they form the core unit 401 constituted as a single integrated unit. In this case also, by providing a difference in the heights of the center cores 406, 407 and the side cores 408, 409, an empty space may be formed as a magnetic gap between one end surface of the center cores 406, 407 and one of the planar cores 404 or 405, or between one end surface of the side cores 408, 409 and one of the planar cores 404 or 405. The magnetic gap may be a spacer gap.

Moreover, at least one of the cores that comprise the core unit 401, namely the planar cores 404, 405, the center cores 406, 407, and the side cores 408, 409, may be formed by compression-molding of permalloy, Sendust, or other such powder, in a construction that uses a so-called compressed metal powder core. In the compressed metal powder core portion of the core unit 401 the saturation magnetic flux density can be increased, thus enabling the inductance element 400 to be made more compact.

In particular, forming the planar cores 404, 405 of compressed metal powder enables the cross-sectional area S12 of the planar cores 404, 405 to be decreased, which in turn enables the thicknesses of the planar cores 404, 405 to be reduced. Therefore, the vertical height of the inductance element 400 can be reduced.

In the inductance elements 100 (200, 300, 400) in the embodiments described above, an adhesive agent mixing magnetic powder such as ferrite with an epoxy resin or an acryl resin may be applied around the coils 102 (202, 203, 302, 303, 402, 403) to prevent magnetic flux leakage. The magnetic characteristics may be changed by adjusting the amount of adhesive agent applied as appropriate.

In addition, the space in the inductance element 100 (200, 300, 400) between the coil(s) 102 (202, 203, 302, 303, 402, 403), and the interior(s) of the core unit(s) 101 (201, 301, 401) may be filled with an adhesive agent containing magnetic powder to prevent magnetic flux leakage. The magnetic characteristics may be changed by adjusting the amount of adhesive agent supplied as appropriate.

Besides ferrites, such as Ni—Zn ferrite and Mn—Zn ferrite, metallic magnetic material, amorphous magnetic material and the like may be used as the magnetic material used to form the core unit 101 (201, 301, 401) in the embodiments described above.

Thus, as described above, making the core unit 101 (201, 301, 401) of compressed metal powder enables the saturation magnetic flux density to be increased, thus further enabling the inductance element 100 (200, 300, 400) to be made even more compact.

It should be noted that, with respect to the number of coils in the inductance element, the present invention is not limited to the one or two in the embodiments described above, and therefore there may be three or more coils.

In addition, although in the embodiments described above the recessed portions 106*g*, 208*g*, 208*h*, 308*g*, 308*h*, 408*b*1, 408*b*2, 409*b*1, 409*b*2 are arc-shaped concave surfaces, such recessed portions are not limited to an arc shape, and consequently, may be oval, or rectangular. However, the arc shape reduces the gap with the coil, thus enabling magnetic flux leakage to be effectively reduced.

As many apparently widely different embodiments of the present invention can be made without departing from the spirit and scope thereof, it is to be understood that the invention is not limited to the specific preferred embodiments described above thereof except as defined in the claims.

What is claimed is:

1. A magnetic element comprising:

a first wound coil;

a first center core inserted into said first wound coil, first and second planar cores disposed on top and on bottom of said first center core respectively, and a side core disposed to the side of said first center core; said side core having a recessed portion shaped to accommodate said first wound coil; and wherein a cross-sectional area of said side core is equal or larger than the size of a cross-sectional area of said first center core wherein said side core and said first center core form a single integrated unit with at least one of said first and second planar cores.

2. The magnetic element according to claim 1, wherein a cross-sectional area of said side core is from 1 to 5 times the size of a cross-sectional area of said first center core.

3. The magnetic element according to claim 1, wherein the cross-sectional area of said first or second planar core is equal or larger than the site of a cross-sectional area of said first center core.

4. The magnetic element according to claim 1 further comprising, a second wound coil; a second center core inserted in said second wound coil, and wherein said side core is disposed between said first and second wound coils.

5. The magnetic element according to claim 4, wherein said side core is mounted at a center of said first and/or second planar core in a longitudinal direction of said first and/or second planar core, and wherein said first and/or second center core is provided at two locations between said side core and both ends of said first and/or second planar core in the longitudinal direction thereof.

6. The magnetic element according to claim 4, wherein the cross-sectional area of said first or second planar core is equal to or larger than the size of a cross-sectional area of said first or second center core.

7. The magnetic element according to claim 1 further comprising: a second wound coil; a second center core inserted in said second wound coil, wherein two side cores are mounted at both ends of said planar core in the longitudinal direction thereof, and wherein said first and the second center cores are provided with a predetermined distance apart between said two side cores respectively.

8. The magnetic element according to claim 7, wherein the cross-sectional area of said first or second planar core is equal or larger than the size of a cross-sectional area of said first or second center core.

9. The magnetic element according to claim 1, wherein two side cores are mounted at both ends of said first or second planar core in a short direction thereof respectively, and wherein said first or second center core is provided with a predetermined distance apart between said two side cores respectively.

10. The magnetic element according to claim 9, wherein the cross-sectional area of said first or second planar core is equal or larger than the size of a cross-sectional area of said first or second center core.

11. The magnetic element according to claim 1, wherein an adhesive containing magnetic material is applied around said first wound coil.

12. The magnetic element according to claim 1, wherein at least one of said first or second center core, said first or second planar core and said side cores is formed from compressed metal powder.

13. The magnetic element according to claim 1, wherein at least one core from a group consisting of said center core, said side core and said planar core is made of more saturation magnetic flux density than other of core body from said group.

* * * * *